US010321741B2

(12) United States Patent
Kang

(10) Patent No.: US 10,321,741 B2
(45) Date of Patent: Jun. 18, 2019

(54) NECKTIE RETAINING CLIP

(71) Applicant: Eung Tae Kang, Seoul (KR)

(72) Inventor: Eung Tae Kang, Seoul (KR)

( * ) Notice: Subject to any disclaimer, the term of this patent is extended or adjusted under 35 U.S.C. 154(b) by 0 days.

(21) Appl. No.: 15/741,120

(22) PCT Filed: Mar. 16, 2016

(86) PCT No.: PCT/KR2016/002622
§ 371 (c)(1),
(2) Date: Dec. 29, 2017

(87) PCT Pub. No.: WO2017/052013
PCT Pub. Date: Mar. 30, 2017

(65) Prior Publication Data

US 2018/0184765 A1 Jul. 5, 2018

(30) Foreign Application Priority Data

Sep. 23, 2015 (KR) ..... 20-2015-0006326 U

(51) Int. Cl.
*A44B 6/00* (2006.01)

(52) U.S. Cl.
CPC ..... *A44B 6/00* (2013.01)

(58) Field of Classification Search
CPC ..... A44B 6/00; A44D 25/003
USPC ..... 24/66.4, 49.1, 66.1, 66.5
See application file for complete search history.

(56) References Cited

U.S. PATENT DOCUMENTS 5,414,908 A * 5/1995 Haines ..... A44B 6/00 24/336

FOREIGN PATENT DOCUMENTS

| | | | | |
|---|---|---|---|---|
| DE | 29703019 U1 * | 3/1998 | ..... | A41D 25/003 |
| JP | 09-238711 A | 9/1997 | | |
| JP | 2002-306211 A | 10/2002 | | |
| KR | 20-0168536 Y1 | 2/2000 | | |
| KR | 20-0286070 Y1 | 8/2002 | | |
| KR | 20-0307595 Y1 | 3/2003 | | |
| KR | 10-2007-0047260 A | 5/2007 | | |

* cited by examiner

*Primary Examiner* — Jack W Lavinder
(74) *Attorney, Agent, or Firm* — Novick, Kim & Lee, PLLC; Jae Youn Kim

(57) ABSTRACT

Provided is a necktie retaining clip which is connected to the back of a necktie to secure the necktie to a shirt, the necktie retaining clip including: a plate-shaped attachment member connected to a loop of cloth sewn on the back of the necktie so as to be detachable and having a fastening piece formed on the lower end portion thereof; a connecting member that connects the attachment member and a retaining member; and the retaining member connected to the connecting member so as to be rotatable. It is possible to tightly secure a necktie by connecting the retaining clip to a shirt, thereby preventing the necktie from falling to the front or being tilted and facilitating wearing and attaching/detaching the retaining clip.

5 Claims, 9 Drawing Sheets

NECKTIE RETAINING CLIP

TECHNICAL FIELD

The present invention relates to a necktie retaining clip and more particularly, to a necktie retaining clip connected to the back of a necktie to secure the necktie to a shirt.

BACKGROUND ART

In general, a necktie refers to a fabric that is worn around the neck or under a collar to make a knot and hangs forward, or dresses stylishly by making a knot with a butterfly shape when a suit is worn.

The origin of the necktie goes back to the 17th century, and in order to protect the French royal family, when Croatian soldiers arrived in Paris, scarves that are given by the family are worn around their necks in hopes of their return to war. When the Louis XIV of France who has shown interest in wearing the scarves asked what the scarves are, the grand chamberlain answered 'cravate' which means Croatian soldiers without knowing the meaning of the question. As a result, scarves worn around men's necks become 'cravate' and currently, the necktie is called 'cravate' in French.

As such, the style of wearing a cloth such as a scarf on the neck was fashionable as an army dress until the 18th century, gradually spreading to the general public, and thereafter, the scarf was used as a decorative accessory for general men's suits until the First World War. In the second half of the 19th century, there was a trend that emphasized the knot part of the cravate in the UK, which was a bow tie. Also, there is a similar time when ascot ties are worn only when people are assembled in racetracks.

Subsequently, the main long-form 'four in hand' necktie was popular today, and the 'four in hand' means a horse drawn by four horses, and the 'four in hand' necktie which has been popular to horsemen has spread to the general public and has been widely used until now.

When the necktie is worn on the shirt, the necktie has a shape falling down from the neck, but the necktie itself is generally not provided with a separate fastener. Accordingly, when a person goes out or moves outdoors, the necktie is shaky and crooked, or falls over the back of the shoulder when the wind blows. When the person bends the upper body when eating and washing while the person moves indoors, the necktie moves forward and may be easily contaminated by foreign matters such as food on the table or water in the sink.

Thus, a necktie pin has been developed, and the necktie pin is secured by putting a pointed pin on a shirt and putting a small metal backrest on its back, tucking it with the end of the pin or screwing it into place or made in a forceps to secure the necktie and the shirt at the same time.

However, the conventional necktie pin is mainly made of metal and may be easily detached from the shirt or the necktie, so that there is a risk of loss, and there is a problem that it is inconvenient to wear due to its weight, and the price is relatively high.

In the related art, in Korean Patent Publication No. 10-2007-0047260 (published on May 4, 2007), there is disclosed a necktie pin lock function Y shirt which adds a necktie pin lock function to the garment itself by attaching a loss prevention ring connected with a bottom nipple pocket having the retaining function of the necktie pin on the shirt itself to the upper end of the front part.

However, in the above-described related art, since the necktie pin retaining function is added to the shirt itself, the necktie retaining function may not be used unless the shirt is bought and thus, the necktie pin retaining function may not be applied to existing shirts and neckties which have been possessed.

DISCLOSURE

Technical Problem

The present invention has been made in an effort to provide a necktie retaining clip capable of preventing the necktie from falling to the front or being tilted and facilitating wearing and attaching/detaching the retaining clip by tightly securing a necktie by connecting the retaining clip to a shirt.

The present invention has been also made in an effort to provide a practical necktie retaining clip which is lightweight, simple in structure, low in cost, is not detached from the necktie in the retaining clip during wearing, does not hinder the beauty because the retaining clip is not exposed to the outside of the necktie, and is used for both existing shirts and neckties which have been retained.

Technical Solution

An exemplary embodiment of the present invention provides a necktie retaining clip which is connected to the back of a necktie to secure the necktie to a shirt, the necktie retaining clip including: a plate-shaped attachment member detachably connected to a loop of cloth sewn on the back of the necktie and having a fastening piece formed on the lower end portion thereof; a connecting member that connects the attachment member and a retaining member; and the retaining member which is rotatably connected to the connecting member, has upper and lower retaining pieces formed on the upper and lower portions thereof and located on the outside of the shirt when the retaining clip is worn, has a protruding piece formed on the lower portion of the lower retaining piece to be fastened to the fastening piece, has a guide piece formed between the upper and lower retaining pieces so as to be spaced apart from the upper and lower retaining pieces and located on the inside of the shirt when the retaining clip is worn.

The attachment member may be formed so as to mark at least one of letters, numbers, symbols, logos, figures, and drawings or penetrate.

The retaining member may have a gripping piece which protrudes from one side.

The upper and lower retaining pieces may have engaging pieces formed at the end portions thereof to be engaged to an opening portion of a placket having a button hole of the shirt.

The guide piece may have an extension portion formed by extending the end portion to the other side to be easily connected to the shirt of the retaining member.

Advantageous Effects

According to the present invention, it is possible to tightly secure a necktie by connecting the retaining clip to a shirt, thereby preventing the necktie from falling to the front or being tilted and facilitating wearing and attaching/detaching the retaining clip.

Further, there is a practical effect in that the necktie retaining clip is lightweight, simple in structure, low in cost, is not detached from the necktie in the retaining clip during wearing, does not hinder the beauty because the retaining clip is not exposed to the outside of the necktie, and is used for both existing shirts and neckties which have been retained.

MODES OF THE INVENTION

Figure 1:
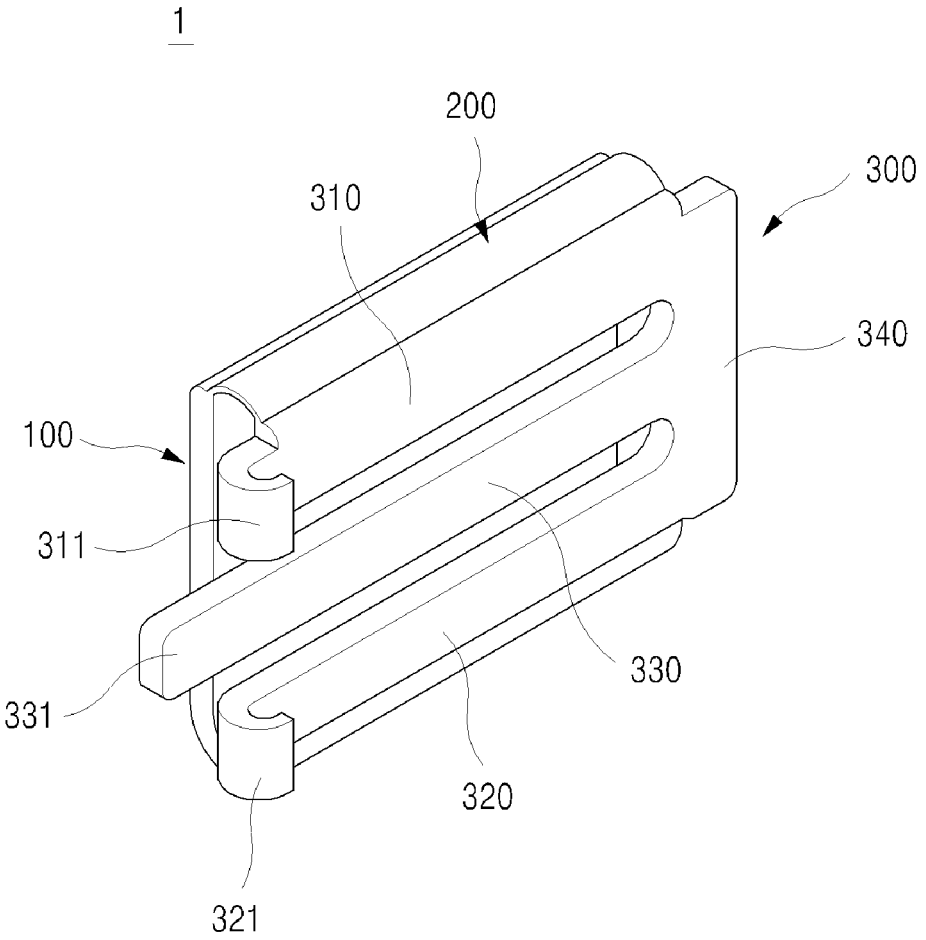
Figure 2:
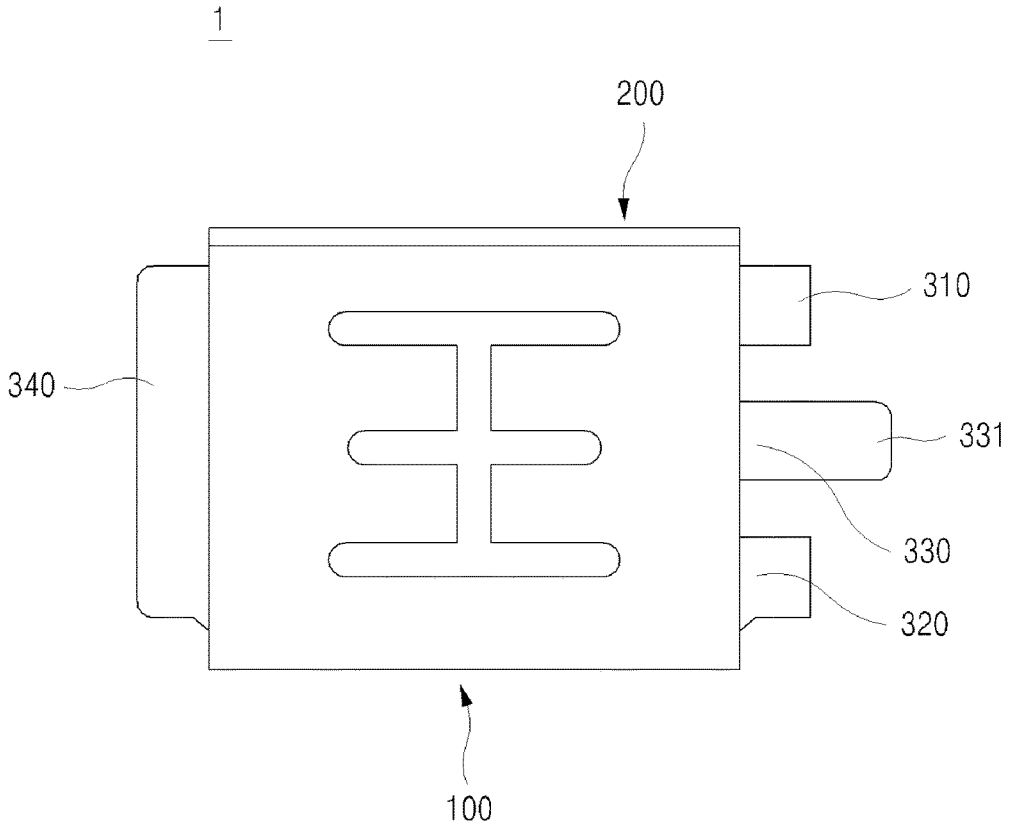
FIG. 2 is a front view of the necktie retaining clip according to the present invention.
Figure 3:
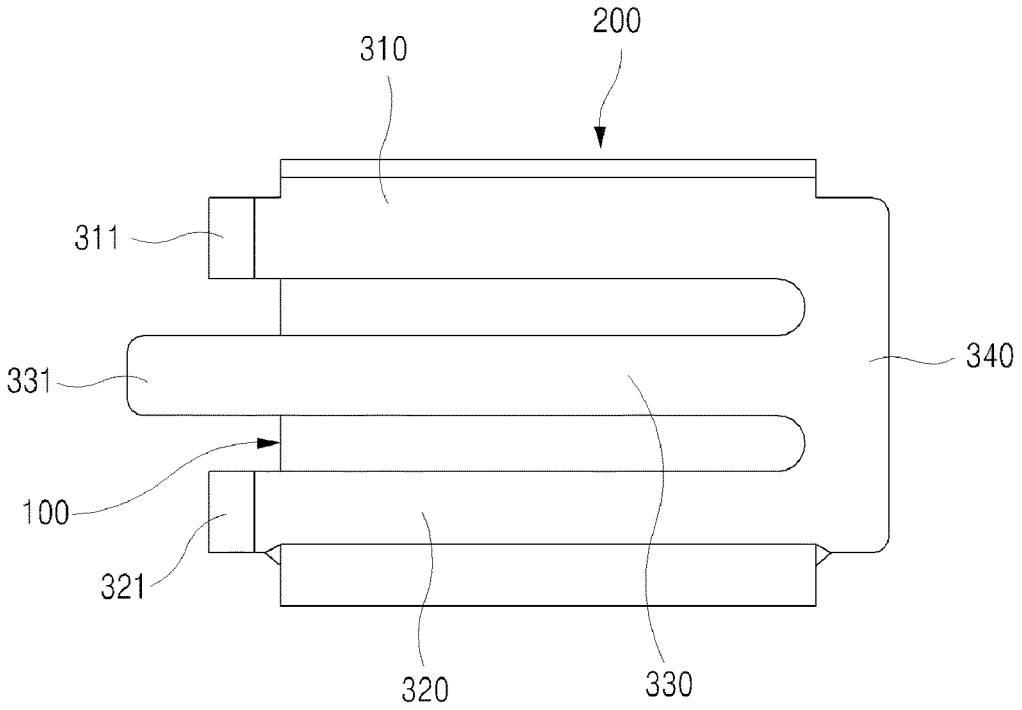
FIG. 3 is a rear view of the necktie retaining clip according to the present invention.
Figure 4:
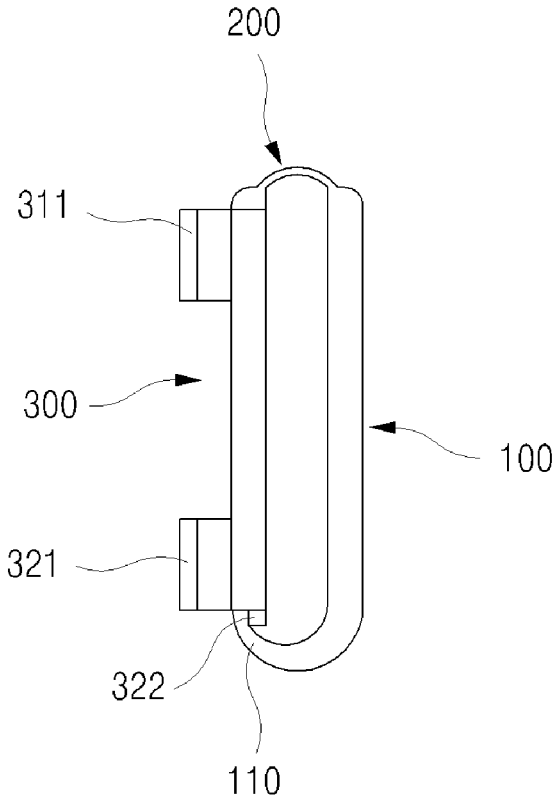
FIG. 4 is a left side view of the necktie retaining clip according to the present invention.
Figure 5:
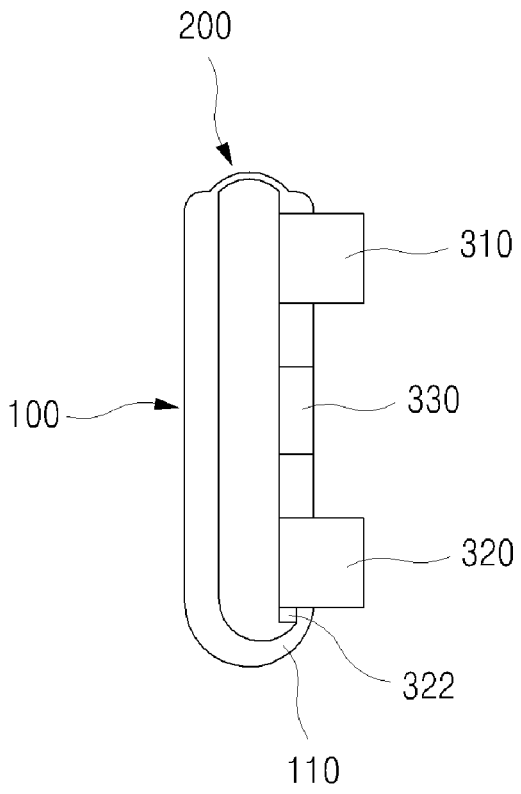
FIG. 5 is a right side view of the necktie retaining clip according to the present invention.
Figure 6:
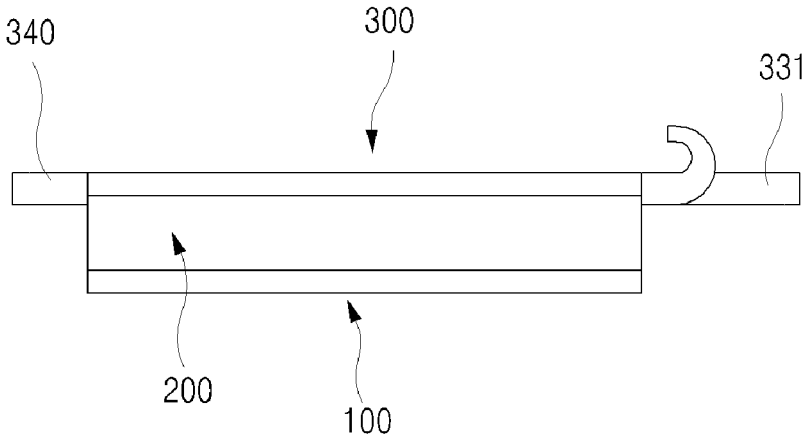
FIG. 6 is a plan view of the necktie retaining clip according to the present invention.

Hereinafter, detailed contents for implementing a necktie retaining clip according to the present invention will be described in detail based on exemplary embodiments with reference to the accompanying drawings.

Referring to FIGS. 1 to 6, a necktie retaining clip 1 according to the present invention is connected to the back of a necktie N to secure the necktie to a shirt S and the necktie retaining clip 1 is made of a lightweight synthetic material and includes an attachment member 100, a connecting member 200, and a retaining member 300.

The attachment member 100 is detachably connected to a loop of cloth N1 sewn on the back of the necktie N, the loop of cloth N1 is formed to penetrate vertically, the bland of the necktie is marked on the loop of cloth N1 to have a label function or the label is sewn separately from the loop of cloth N1.

Further, the attachment member 100 has a plate shape and is connected and attached to the necktie through a penetrating hole of the loop of cloth N1 and has a fastening piece 110 which is bent upward at the lower end portion.

In addition, the attachment member 100 may be formed so as to mark at least one of letters, numbers, symbols, logos, figures, and drawings or have the shapes thereof.

The connecting member 200 connects the attachment member 100 and the retaining member 300 to open and close the retaining member 300 with respect to the attachment member 100 and smoothly rotate the retaining member 300.

The retaining member 300 is connected to the connecting member 200 and is openable and closable with respect to the attachment member 100 and is connected to the shirt S to secure the necktie N to the shirt S.

To this end, the retaining member 300 is formed at one side so that a gripping piece 340 protrudes to one side to easily attach or detach the retaining clip 1 to or from the loop of cloth N1 of the back of the necktie while a user grips the gripping piece 340 and may conveniently secure the necktie N to the shirt S by connecting the retaining clip 1 to the shirt S.

Further, upper and lower retaining pieces 310 and 320 are formed at the upper and lower portions of the retaining member 300. More particularly, the upper and lower retaining pieces 310 and 320 are formed to be elongated in a horizontal direction toward the other side at the upper and lower portions of the gripping piece 340.

Further, a guide piece 330 is formed between the upper and lower retaining pieces 310 and 320 to be spaced apart from the upper and lower retaining pieces 310 and 320. More particularly, the guide piece 330 is formed to be elongated in a horizontal direction toward the other side in the middle of the gripping piece 340.

In this case, the upper retaining piece 310 is connected to the connecting member 200 and the lower retaining piece 320 has a protruding piece 322 formed at the lower portion to be fastened to the fastening piece 110 of the attachment member 100 by rotating the retaining member 300 while the attachment member 100 is attached to the loop of cloth N1 of the necktie N, thereby preventing the retaining clip 1 worn on the necktie N from being easily detached from the necktie.

Further, the upper and lower retaining pieces 310 and 320 have engaging pieces 311 and 321 formed at each end portion. In addition, the guide piece 330 has an extension portion 331 formed when the end portion is further extended to the other side than the upper and lower retaining pieces 310 and 320.

Figure 7A:
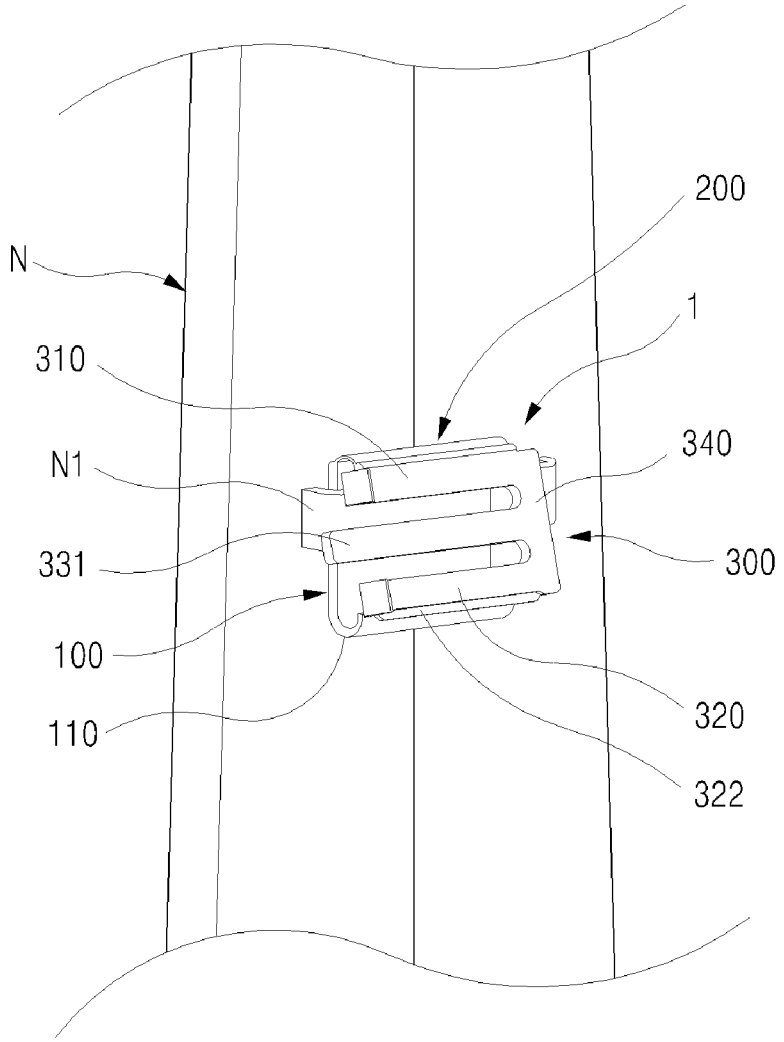
FIGS. 7*a* to 7*d* are diagrams illustrating a wearing process of the necktie retaining clip according to the present invention.
Figure 7B:
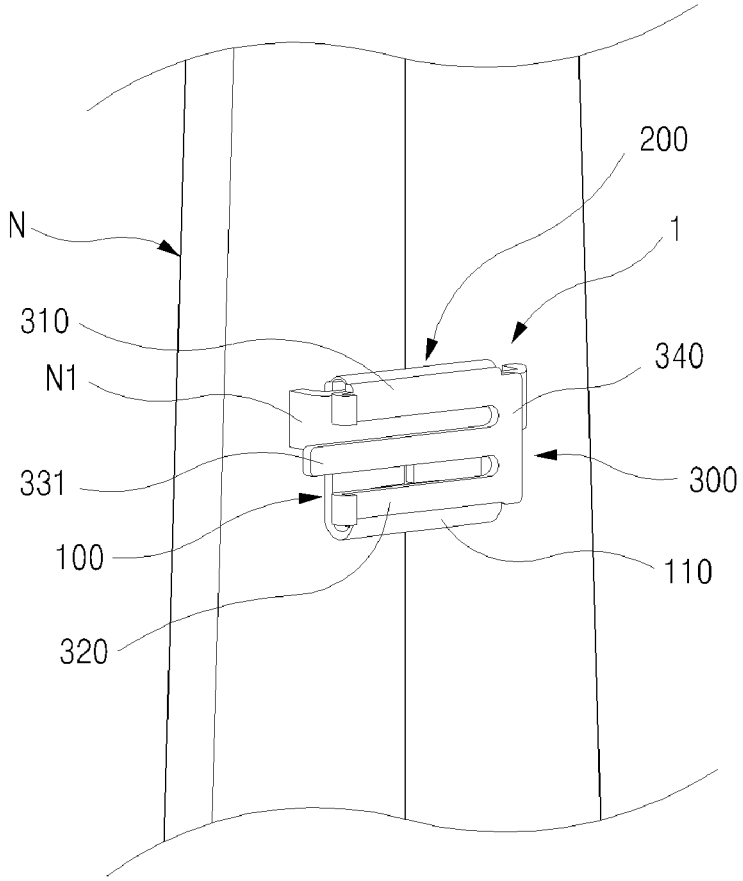
Figure 7C:
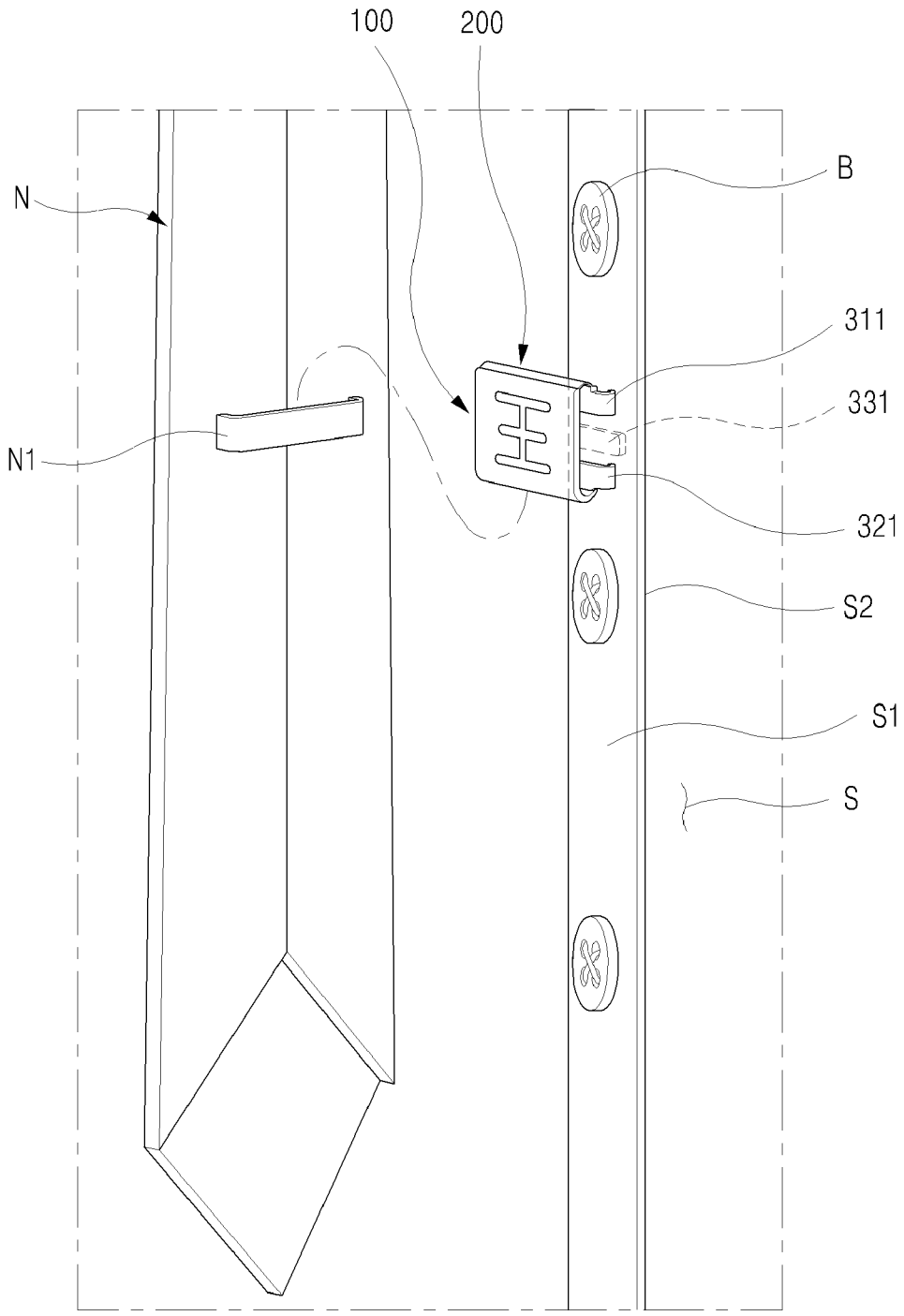
Figure 7D:
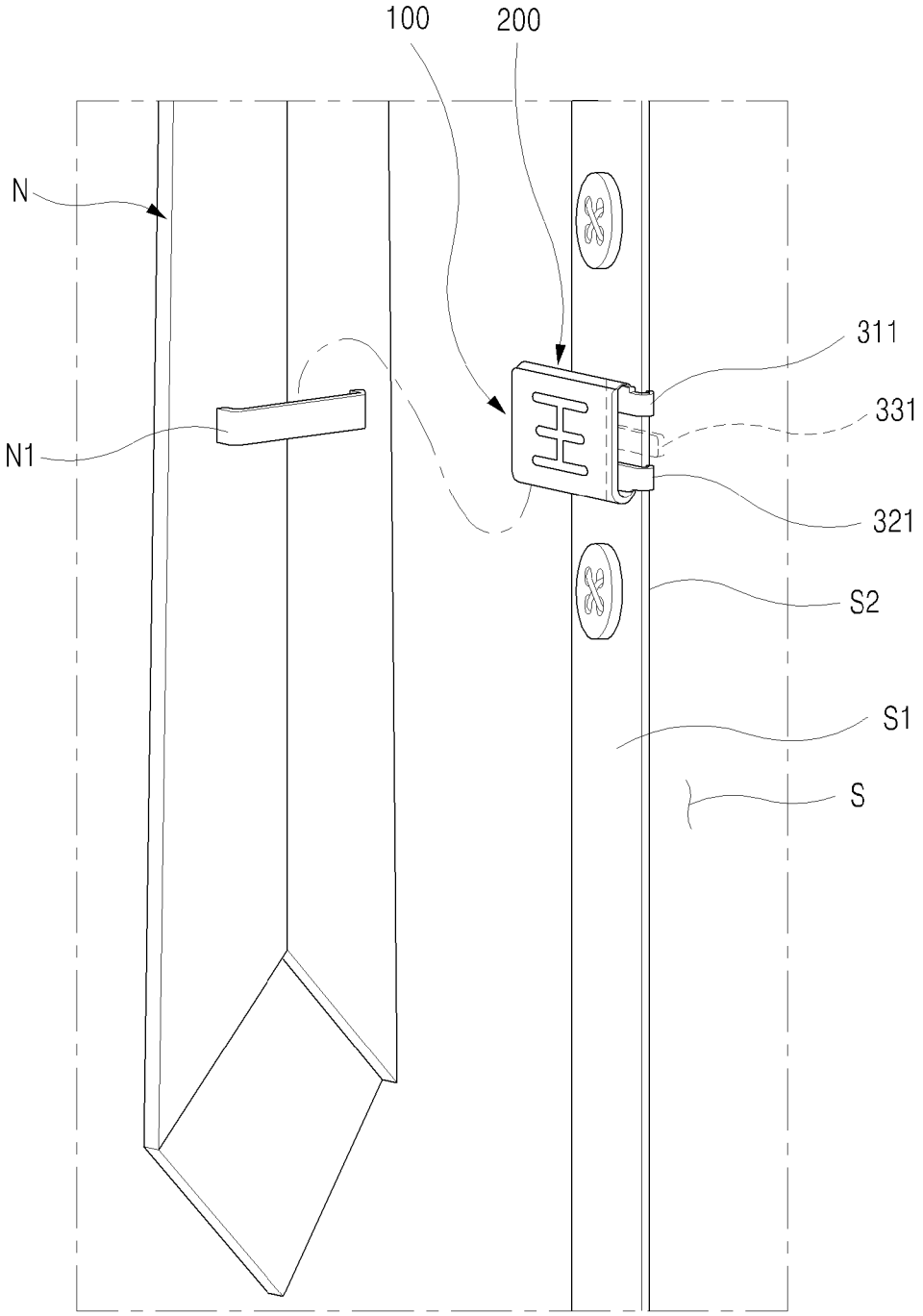

Therefore, as illustrated in FIG. 7*a*, while the user grips the gripping piece 340 with one hand, the attachment member 100 is hung and attached to the loop of cloth N1 of the back of the necktie N, and thereafter, as illustrated in FIG. 7*b*, the retaining member 300 rotates to be fastened to the attachment member 100. As illustrated in FIG. 7*c*, while the other hand holds the extension portion 331 and is opened, the upper and lower retaining pieces 310 and 320 are positioned on the outer surface of the shirt S and while the guide piece 330 is positioned on the inner surface of the shirt S, the retaining clip 1 is pushed into the shirt to be easily connected with the shirt S. In this case, as illustrated in FIG. 7*d*, the engaging pieces 311 and 321 formed at the upper and lower retaining pieces 310 and 320 are engaged to an opening portion S2 of a placket S1 having a button hole of the shirt S to firmly secure the necktie N to the shirt S, thereby preventing the necktie from falling to the front or being tilted.

As a result, according to the present invention, the necktie retaining clip 1 tightly secures the necktie by connecting the retaining clip to a shirt, thereby preventing the necktie from falling to the front or being tilted and facilitating wearing and attaching/detaching the retaining clip. Further, there is a practical effect in that the necktie retaining clip is lightweight, simple in structure, low in cost, is not detached from the necktie in the retaining clip during wearing, does not hinder the beauty because the retaining clip is not exposed to the outside of the necktie, and is used for both existing shirts and neckties which have been possessed.

The exemplary embodiment of the present invention is just an example and the present invention is not limited thereto. Anything having substantially the same configuration and the same operational effect as the technical idea described in appended claims of the present invention are included in the technical scope of the present invention.

INDUSTRIAL AVAILABILITY

According to the present invention, since the necktie retaining clip tightly secures a necktie by connecting the retaining clip to a shirt, thereby preventing the necktie from falling to the front or being tilted and facilitating wearing and attaching/detaching the retaining clip and has a lightweight and simple structure, the necktie retaining clip has the industrial availability.

The invention claimed is:

1. A necktie retaining clip which is configured to be connected to a back of a necktie to secure the necktie to a shirt, the necktie retaining clip comprising:

a plate-shaped attachment member detachably configured to be connected to a loop of cloth sewn on the back of the necktie and having a fastening piece formed on a lower end portion thereof; and a connecting member that connects the plate-shaped attachment member and a retaining member, wherein the retaining member which is rotatably connected to the connecting member, has upper and a lower retaining pieces formed on upper and a lower portions thereof and located on an outside of the shirt when the retaining clip is worn, has a protruding piece formed on a lower portion of the lower retaining piece to be fastened to the fastening piece, has a guide piece formed between the upper and lower retaining pieces so as to be spaced apart from the upper and lower retaining pieces and located on an inside of the shirt when the retaining clip is worn.

2. The necktie retaining clip of claim 1, wherein the plate-shaped attachment member has at least one of letters, numbers, symbols, logos, figures, and drawings formed thereon or formed by one or more holes penetrating therethrough.

3. The necktie retaining clip of claim 1, wherein the retaining member has a gripping piece which protrudes from one side.

4. The necktie retaining clip of claim 1, wherein the upper and lower retaining pieces have engaging pieces formed at end portions thereof respectively to be engaged to an opening portion of a placket having a button hole of the shirt.

5. The necktie retaining clip of claim 1, wherein the guide piece has an extension portion configured to facilitate a connection of the retaining member to the shirt.

* * * * *